US006910531B2

(12) United States Patent
Smith, Jr.

(10) Patent No.: US 6,910,531 B2
(45) Date of Patent: Jun. 28, 2005

(54) ROTATING DRILLING STRIPPER

(75) Inventor: Charles B. Smith, Jr., Houston, TX (US)

(73) Assignee: Vetco Gray Inc., Houston, TX (US)

( * ) Notice: Subject to any disclaimer, the term of this patent is extended or adjusted under 35 U.S.C. 154(b) by 89 days.

(21) Appl. No.: 10/301,304

(22) Filed: Nov. 21, 2002

(65) Prior Publication Data

US 2003/0094276 A1 May 22, 2003

Related U.S. Application Data

(60) Provisional application No. 60/332,076, filed on Nov. 21, 2001.

(51) Int. Cl.[7] ..... E21B 19/00; E21B 33/06

(52) U.S. Cl. ..... 166/84.3; 166/84.4; 277/326; 251/1.1

(58) Field of Search ..... 166/84.3, 84.4, 166/180, 177.3, 78.1, 84.1; 277/326, 327, 512; 251/1.1

(56) References Cited

U.S. PATENT DOCUMENTS

| | | | | | |
|---|---|---|---|---|---|
| 1,805,344 | A | * | 5/1931 | Siefken | 277/330 |
| 2,862,735 | A | | 12/1958 | Knox | |
| 3,222,075 | A | * | 12/1965 | Haeber | 277/327 |
| 3,486,759 | A | * | 12/1969 | Lewis | 277/323 |
| 4,441,551 | A | | 4/1984 | Biffle | |
| 4,452,421 | A | * | 6/1984 | Huey et al. | 251/1.2 |
| 4,480,703 | A | | 11/1984 | Garrett | |
| 4,486,025 | A | | 12/1984 | Johnston | |
| 4,500,094 | A | | 2/1985 | Biffle | |
| 4,657,263 | A | * | 4/1987 | Hynes et al. | 277/327 |
| 4,658,894 | A | | 4/1987 | Craig | |
| 5,178,215 | A | | 1/1993 | Yenulis et al. | |
| 5,588,491 | A | | 12/1996 | Brugman et al. | |
| 5,647,444 | A | | 7/1997 | Williams | |
| 5,901,964 | A | | 5/1999 | Williams et al. | |
| 6,016,880 | A | | 1/2000 | Hall et al. | |
| 6,109,348 | A | | 8/2000 | Caraway | |
| 6,129,152 | A | | 10/2000 | Hosie et al. | |
| 6,244,359 | B1 | | 6/2001 | Bridges et al. | |

* cited by examiner

*Primary Examiner*—Kenneth Thompson
(74) *Attorney, Agent, or Firm*—Bracewell & Giuliani LLP

(57) ABSTRACT

A stripper assembly for sealing around a drill pipe includes an outer housing having a lateral outlet. The outer housing is mounted at an upper end of a well for receiving an upward flow of drilling fluid and diverting the drilling fluid through the lateral outlet. An inner member is rotatably mounted in the outer housing. A rigid cartridge housing is mounted to the inner member for rotation therewith. The cartridge housing is open to drilling fluid. An annular elastomeric seal member is located in the cartridge housing. The cartridge housing limits upward, downward and outward movement of the seal member as it deforms against the drill pipe due to drilling fluid pressure.

10 Claims, 2 Drawing Sheets

ROTATING DRILLING STRIPPER

CROSS-REFERENCE TO RELATED APPLICATIONS

This application claims the priority of U.S. Provisional patent application Ser. No. 60/332,076 filed Nov. 21, 2001.

BACKGROUND OF THE INVENTION

1. Field of the Invention

The present invention relates generally to rotating drilling head systems in which an elastomer seals around and grips a rotating drill pipe during drilling operations.

2. Description of the Related Art

Oil and gas wells are typically drilled by use of a rotating drill pipe with a drill bit at the lower end. Drilling fluids are pumped down the drill pipe and out the drill bit. The drilling fluid returns to the surface, along with cuttings, through the annulus around the drill pipe. In many cases, the pressure at the upper end of the drill pipe annulus is atmospheric. The weight of the drilling fluid is controlled to provide a hydrostatic pressure at the earth formations that is greater than the formation pressure to prevent blowouts.

In some cases, however, it is advantageous to isolate the pressure at the upper end of the drilling fluid column from atmospheric pressure. For example, in highly deviated well, a lightweight drilling fluid may be used that is not heavy enough to prevent upward flow in the well due to formation pressure. A drilling head at the upper end of the well controls the pressure. Drilling head systems use an elastomeric element to seal the drilling head against the rotating drill pipe during drilling operations. In some rotating drilling head systems, the seal is formed by the natural resiliency of the elastomeric element against the drill pipe while others use hydraulic pressure to deform the seal element. In U.S. Pat. No. 6,016,880, hydraulic pressure to energize an elastomeric gripper element that is located above an elastomeric primary seal. The gripper grips the drill pipe to cause the gripper and primary seal to rotate with the drill pipe. The gripper also serves as a secondary seal in the event of leakage of the primary seal.

The primary seal of the '880 patent and in other prior art normally comprises an elastomeric seal with a tapered exterior that is exposed to drilling fluid pressure. The drill string has enlarged tool joint sections at the end of each drill pipe that must pass through the interior of the seal. The drilling fluid pressure and movement of the drill pipe through the seal causes extrusion of the seal, which limits the life of the seal.

SUMMARY OF THE INVENTION

A stripper assembly for sealing around a drill pipe has an annular elastomeric seal member with an inner passage for receiving drill pipe. The seal member has an upper end, a lower end and an outer sidewall. A rigid outer support member extends around and is bonded to an exterior portion of the sidewall of the seal member. An annular rigid lower support member bonded to the lower end of the seal member around the inner passage. The seal member is exposed to drilling fluid pressure, causing a lower portion of the sidewall to deform the seal member inwardly around a drill pipe.

In the preferred embodiment, the seal member, along with the support members, is mounted inside a cartridge housing. The housing has upper and lower ends an a cylindrical outer wall. The outer wall has at least one hole for admitting drilling fluid. The upper end and lower ends of the seal member engage the upper and lower ends of the cartridge housing. A portion of the outer sidewall of the seal member engages the outer wall of the housing.

Preferably, the seal member is configured to define a cavity at upper portion of its outer sidewall. The cavity spaces part of the seal member inward from the cartridge housing while not under drilling fluid pressure. The seal member deforms into this cavity while under drilling fluid pressure.

BRIEF DESCRIPTION OF THE DRAWINGS

So that the manner in which the described features, advantages and objects of the invention, as well as others which will become apparent, are attained and can be understood in detail, more particular description of the invention may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

DETAILED DESCRIPTION

Figure 1:
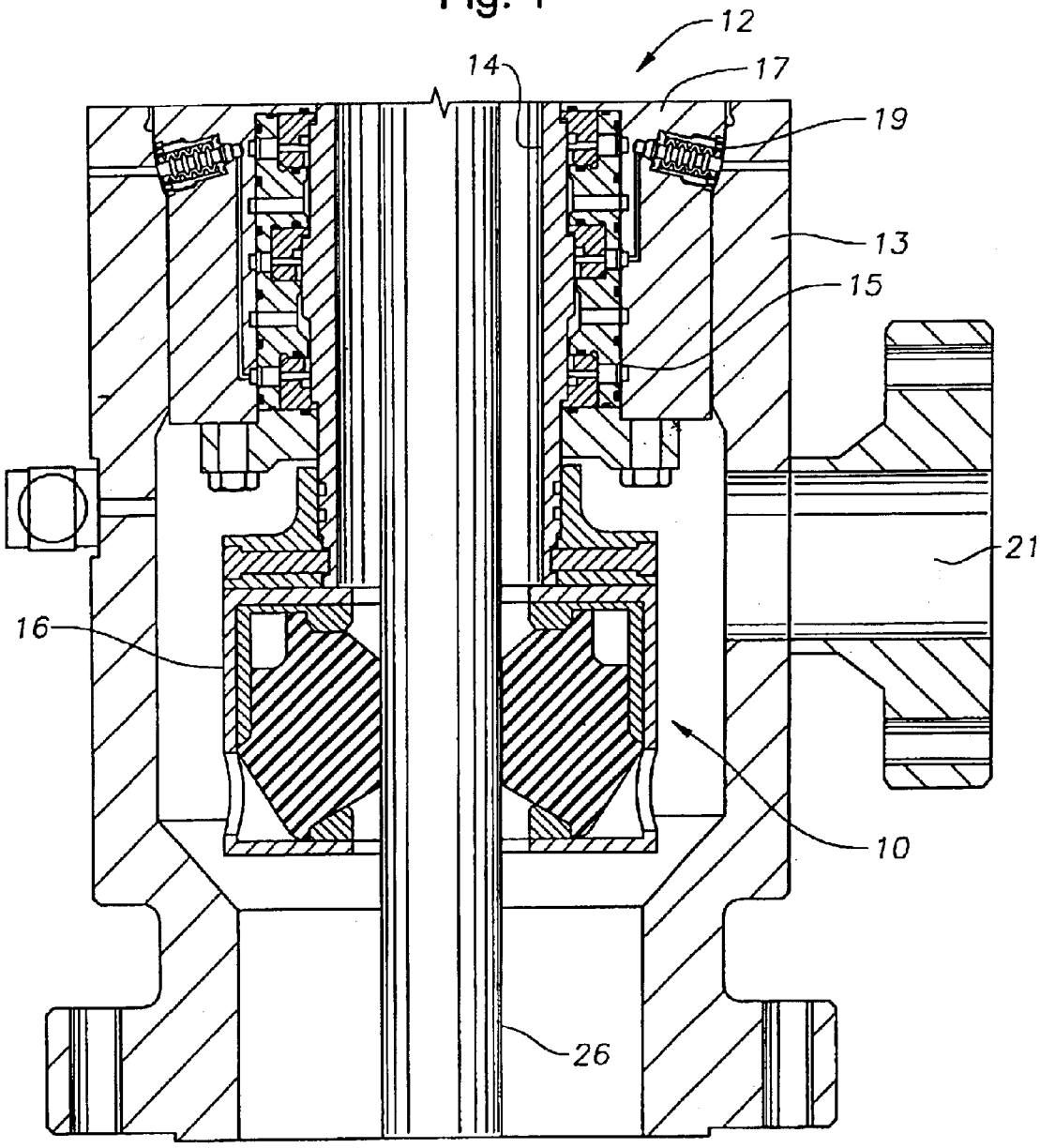
FIG. 1 is an orthogonal view of a rotating drilling stripper constructed in accordance with the present invention.

FIG. 1 shows a rotating drilling stripper 10 constructed in accordance with the present invention. Stripper 10 is used in drilling operations and is preferably a lower portion of cartridge 12 (partially shown) of a rotating drilling head. Stripper 10 rotates with rotating portion of cartridge 12, but the present invention would permit a rotational connection between them. In the embodiment of FIG. 1, cartridge 12 and stripper 10 are generally located very near the drilling rig floor. The primary function of stripper 10 is to provide a seal near the upper end of the well annulus through which drilling fluids return.

The drilling head includes a drilling head housing 13 that is coupled to well casing (not shown) that extends some distance below the surface into the well bore, as well as some distance above the surface, approximately to the drilling rig floor. Cartridge 12 and stripper 10 are inside housing 13. Housing 13 forms the outer boundary of the well annulus where housing 13 is present. Cartridge 12 has a rotatable inner sleeve 14 and a stationary outer sleeve 17.

A gripper element (not shown), such as shown in U.S. Pat. No. 6,016,880, is mounted to inner sleeve 14 above seals 15 and, when supplied with hydraulic fluid pressure, will grip drill pipe 26 to cause inner sleeve 14 and stripper 10 to rotate with drill pipe 26. Seals 15 seal between inner and outer sleeves 14, 17. Lubricant is circulated via passages 19. Lateral outlet 21 of housing 13 below seal 15 is in fluid communication with the annulus to return the drilling fluid from the annulus to the pump (not shown) for recirculation.

Stripper 10 mounts to cartridge 12 below seals 15 by conventional means. For example, stripper 10 can be attached to cartridge 12 by passing threaded bolts through a flanged end of cartridge 12 into threaded holes (not shown) in housing 16 of stripper 10.

Figure 2:
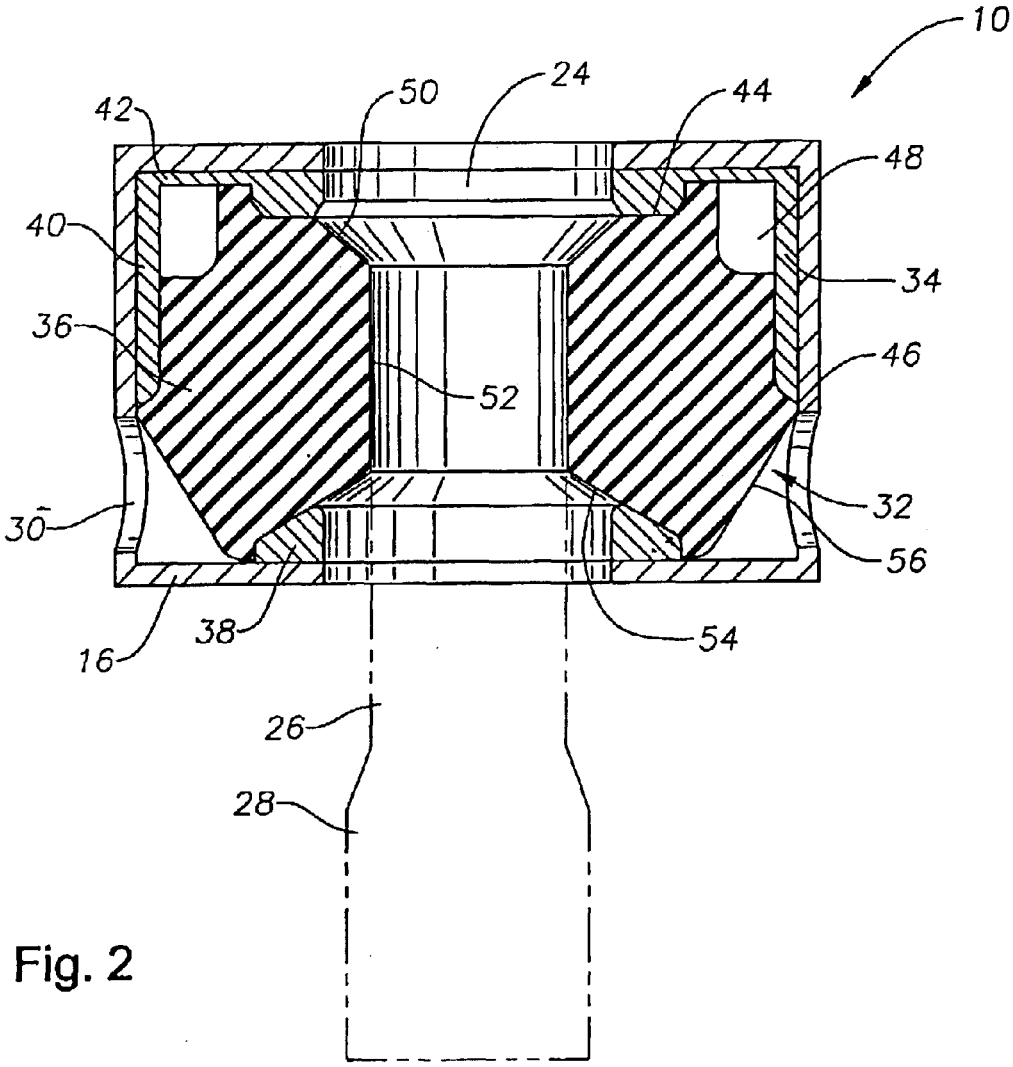
FIG. 2 is a cross section of the rotating drilling stripper of FIG. 1.
Figure 3:
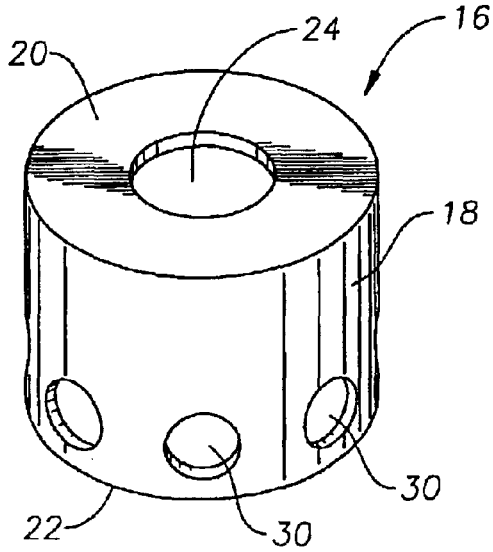
FIG. 3 is an orthogonal view of the housing of the rotating drilling stripper of FIG. 2.

FIG. 2 shows a stripper 10 having a cartridge housing 16. Housing 16 must be constructed of very strong material such as steel to withstand large mechanical loads. FIG. 3 shows housing 16 comprises a cylindrical wall 18 and upper and lower ends 20, 22, respectively. Ends 20, 22 each have an axial opening 24 of sufficient diameter to accommodate a drill pipe 26, including the connecting portion 28 of drill pipe 26, referred to as tool joints 28. Cylindrical wall 18 has holes 30 along its lower portion to allow passage of fluids into the lower interior region of housing 16.

Stripper 10 further comprises a seal unit 32, as shown in FIG. 2. Seal unit 32 comprises a rigid upper support or retainer 34, a seal 36, and a rigid lower support or retainer 38. Upper retainer 34 is a structural support element onto which seal 36 is secured, such as by bonding. The upper retainer 34 shown in FIG. 2 generally conforms to the shape of the upper portion of housing 16. Upper retainer 34 has a cylindrical shell 40 of slightly smaller diameter than wall 18, and, similar to housing 16, has an upper end cap 42 with an axial opening 24 to accommodate drill pipe 26. The portion of end cap 42 nearest drill pipe 26 is slightly thicker than the other portion of end cap 42, forming a circular support shoulder 44. Shell 40 extends down along the interior of wall 18, but stops short of holes 30. The lowermost end of shell 40 tapers quickly to an edge 46 terminating on the interior of wall 18 above holes 30. Upper retainer 34 is attached to housing 16 using conventional means such as screws or bolts (not shown). Housing 16 preferably can be conveniently opened and closed to permit access to its interior region, permitting installation or replacement of seal unit 32. This can be done using various conventional means such as a flange (not shown) connecting end 20 or end 22 to wall 18, or by placing such a flange in the midsection of wall 18 above holes 30.

Seal 36 is preferably made from an essentially incompressible elastomer such as cast urethane or treated natural rubber. Although incompressible, seal 36 is deformable. The embodiment of seal 36 in FIG. 2 is cylindrically symmetric, but has many facets that are most easily described by tracing the cross sectional perimeter of the surface of seal 36. Beginning at edge 46 of shell 40 and extending upward nearly to end cap 42, the outermost surface of seal 36 abuts and is bonded to the inner surface of shell 40. The outer surface of seal 36 stops short of end cap 42, however, and turns radially inward before continuing upward again until it meets and bonds to end cap 42. This forms an annular cavity or recessed area 48 having an approximately rectangular cross section bounded by seal 36, shell 40, and end cap 42.

Continuing along the cross sectional perimeter of seal 36, the upper end of seal 36 extends radially inward along end cap 42 until it meets shoulder 44. The upper end of seal 36 extends down and then radially inward to wrap around and conform to shoulder 44. Where the surface of seal 36 abuts shell 40, end cap 42, and shoulder 44, it adjoins and is held fast by bonding material.

From shoulder 44, the surface of seal 36 tapers simultaneously downward and inward to form an upper transition surface 50. At the inward end of upper transition surface 50, the surface of seal 36 turns and extends downward nearly the entire length of seal 36 to form a cylindrical sealing surface 52. Cylindrical sealing surface 52 is slightly smaller in diameter than drill pipe 26. At the downward end of sealing surface 52, the surface tapers simultaneously downward and outward to form lower transition surface 54. Lower transition surface 54 terminates in abutting contact with end 22 of housing 16. For additional structural support, lower retainer 38 is bonded to seal 36 with bonding material along the lowermost portion of lower transition surface 54. Lower retainer 38 has an inner diameter greater than the inner diameter of seal 36 and slightly greater than the outer diameter of the connecting joints 28 of drill pipe 26.

The remaining portion of the surface of seal 36 extends a very short length outward along end 22 before quickly turning upward and continuing outward until it intersects tip 46, thus returning to our beginning point. The sloped length of seal 36 from end 22 to tip 46 forms a tapered bearing surface 56. Bearing surface 56 presents a frustoconical surface to the drilling fluid.

Stripper 10 effects a seal through a friction fit between sealing surface 52 and the drill pipe 26 that passes through stripper 10. Energy to maintain the seal is provided by upwardly-directed flowing fluids that enter housing 16 through openings 30. In conventional drilling, drilling fluids are forced down through the hollow interior of drill pipe 26 to the drill bit and into the well bore, whereupon the fluid, still under pressure, returns to the surface in the annular region between the drill pipe 26 and the well bore.

While the present invention can be used in such conventional drilling operations, the more modern trend, at least for geologic formations that may be damaged by the pressure exerted by the drilling fluid, is to use underbalanced drilling. Underbalanced drilling relies on overburden pressure to supply the impetus for fluids within the well bore to rise to the surface. Thus, in underbalanced drilling, fluids may rise through the interior of drill pipe 26 as well as the annular region between the drill pipe 26 and the well bore. The present invention is particularly suited for application in underbalanced drilling. In underbalanced drilling, as in conventional drilling, pressurized fluid enters housing 16 through openings 30.

Sealing surface 52 is the portion of seal 36 that actually effects the seal against drill pipe 26 in response to the pressure from the drilling fluid impinging on bearing surface 56. The pressurized fluid that enters into the lower portion of the interior region of housing 16 through holes 30 bears against bearing surface 56. There is a functional relationship between the pressure bearing on bearing surface 56 and the pressure transferred across sealing surface 52. The greater the area of bearing surface 56, the greater the pressure transferred across sealing surface 52.

However, one cannot simply maximize the area of bearing surface 56 to produce the maximum sealing pressure on sealing surface 52. The drill pipe 26 passing through stripper 10, and particularly a tool joint 28, tends to tear seal 36 along or adjacent to sealing surface 52, often at the intersection of sealing surface 52 and upper transition surface 50. Excess sealing pressure exacerbates the problem because sealing surface 52 tends to deform into the region between the drill pipe 26 and shoulder 44, or the drill pipe 26 and lower retainer 38. During those periods in which drill pipe 26 is rapidly removed or inserted (tripping in or tripping out), the frictional force between the drill pipe 26 and sealing surface 52 can cause sealing surface 52 to heat up and weaken. As the tool joint 28 passes by, it tends to lop off the extruded portion, ruining the sealing surface 52. Transition surfaces 50, 54 are designed to assist the passage of the drill pipe 26, particularly the tool joints 28, by allowing the tool joints 28 to impinge on a tapered surface, giving seal 36 an opportunity to deform out of the path of the drill pipe 26 and tool joints 28 as they pass through stripper 10.

Cavity 48 provides a chamber into which seal 36 can deform when pressure is applied to it. By deforming into cavity 48, seal 36 is less likely to deform into the region between the drill pipe 26 and shoulder 44, or the drill pipe 26 and lower retainer 38, and be lopped off or torn by the passing drill pipe 26 or tool joint 28. Thus, as bearing surface 56 transfers the pressure from the pressurized fluid into seal 36, seal 36 may change its shape, but its volume is essentially constant and there is no significant energy loss through seal 36.

If the expected fluid pressure for a given drilling program is known in advance, such as in an exploitation field, one can select a stripper 10 having a bearing surface 56 just large enough to form an effective seal between sealing surface 52 and the drill pipe 26. By using just enough pressure to form an effective seal, and no more, the detrimental effects of overpressuring seal 36 are minimized and the life of seal 36 is extended.

The present invention offers many advantages over the prior art. Placing seal unit 32 inside housing 16 allows for the pre-assembly of strippers having variously sized seals 36 for different drilling environments. It allows for regulating the amount of surface area exposed to the drilling fluid by changing the dimensions of bearing surface 56. Thus, pressures can be regulated by choosing a seal with a bearing surface 56 optimally sized to accommodate expected drilling pressures. By reducing the pressure applied by the sealing surface 52 onto the drill pipe 26, the frictional force between them and unwanted extrusion is reduced. That increases the useful lifetime of seal 36. The useful lifetime of seal 36 is also increased by incorporating a cavity around seal 36, thereby reducing the likelihood of seal 36 deforming into the region between the drill pipe 26 and shoulder 44, or the drill pipe 26 and lower retainer 38, and being lopped off or torn by the passing drill pipe 26 or tool joint 28.

While the invention has been particularly shown and described with reference to a preferred and alternative embodiments, it will be understood by those skilled in the art that various changes in form and detail may be made therein without departing from the spirit and scope of the invention. For example, the outer sidewall retainer 34 and upper shoulder 44 need not be connected together. Upper shoulder 44 and lower retainer 38 could be formed in the interior of cartridge housing 16, and the outer sidewall of seal 36 could be bonded to the interior of housing 16. However, such would not allow housing 16 to be readily reused with a different seal member.

I claim:

1. A stripper assembly for sealing around a drill pipe, comprising:

an annular elastomeric seal member having an inner passage for receiving drill pipe, an upper end, a lower end and a sidewall;

a rigid outer support member that extends around and is bonded to an exterior portion of the sidewall of the seal member;

an annular rigid lower support member bonded to the lower end of the seal member around the inner passage;

the seal member adapted to be exposed to drilling fluid pressure, causing a lower portion of the sidewall to deform the seal member inwardly around a drill pipe;

a cartridge housing having a cylindrical outer wall, the cartridge housing being open to admit drilling fluid;

the seal member being mounted in the cartridge housing for rotating the cartridge housing in unison with the seal member when the drill pipe rotates; and the seal member having an annular upper recessed area located at a junction between the upper end and sidewall of the seal member above the lower support member, the upper recessed area being spaced inward from the cartridge housing to accommodate portions of the seal member during deformation.

2. A stripper assembly for sealing around a drill pipe, comprising:

an annular elastomeric seal member having an inner passage for receiving drill pipe, an upper end, a lower end and a sidewall;

a rigid outer support member that extends around and is bonded to an exterior portion of the sidewall of the seal member;

an annular rigid lower support member bonded to the lower end of the seal member around the inner passage;

the seal member adapted to be exposed to drilling fluid pressure, causing a lower portion of the sidewall to deform the seal member inwardly around a drill pipe;

a cartridge housing having a cylindrical outer wall, with at least one hole in a lower portion of the outer wall to admit drilling fluid;

the seal member being mounted in the cartridge housing for rotating the cartridge housing in unison with the seal member while the drill pipe rotates; and wherein the lower portion of the sidewall of the seal member tapers from the outer support member to the lower support member and is spaced inward from the hole in the outer wall of the cartridge housing.

3. A stripper assembly for sealing around a drill pipe, comprising:

an annular elastomeric seal member having an inner passage for receiving drill pipe, an upper end, a lower end and a sidewall;

a rigid outer support member that extends around and is bonded to an exterior portion of the sidewall of the seal member;

an annular rigid lower support member bonded to the lower end of the seal member around the inner passage;

the seal member adapted to be exposed to drilling fluid pressure, causing a lower portion of the sidewall to deform the seal member inwardly around a drill pipe;

a cartridge housing having a cylindrical outer wall, the cartridge housing being open to admit drilling fluid;

the seal member being mounted in the cartridge housing for rotating the cartridge housing in unison with the seal member when the drill pipe rotates;

the seal member having an annular upper recessed area located at a junction between the upper end and sidewall of the seal member above the lower support member, the upper recessed area being spaced inward from the cartridge housing to accommodate portions of the seal member during deformation; and wherein the lower portion of the sidewall of the seal member tapers from the outer support member to the lower support member and is spaced inward from the hole in the outer wall of the cartridge housing.

4. A stripper assembly for sealing around a drill pipe, comprising:

an outer housing having a lateral outlet, the outer housing adapted to be mounted at an upper end of a well for receiving an upward flow of drilling fluid and diverting the drilling fluid through the lateral outlet;

an inner member rotatably mounted in the outer housing;

a seal between the inner member and the outer housing for preventing drilling fluid from flowing between the inner member and the outer housing;

a rigid cartridge housing mounted below the seal to the inner member for rotation therewith, the cartridge housing being open to drilling fluid pressure;

an annular elastomeric seal member located in the cartridge housing; and wherein the cartridge housing limits upward, downward and outward movement of the seal member as it deforms against the drill pipe due to drilling fluid pressure.

5. The stripper assembly according to claim 4, further comprising:

an annular upper recessed area at a junction of an upper end and a cylindrical sidewall of the seal member, the recessed area being spaced from an outer wall and an upper end of the housing to accommodate deformed portions of the seal member as it deforms against the drill pipe due to drilling fluid pressure.

6. The stripper assembly according to claim 4, wherein the housing has an upper end, lower end and cylindrical sidewall, the sidewall having at least one hole for admitting drilling fluid.

7. The stripper assembly according to claim 4, further comprising:

an annular lower rigid support member bonded to a lower end of the seal member and located within the cartridge housing.

8. The stripper assembly according to claim 4, further comprising:

an annular lower rigid support member bonded to a lower end of the seal member and located within the cartridge housing; and an annular upper rigid support member bonded to an upper end of the seal member and located within the cartridge housing.

9. The stripper assembly according to claim 4, further comprising:

an annular rigid lower support member bonded to a lower end of the seal member and located within the cartridge housing to prevent inward movement of the lower end of the seal member;

an annular rigid upper support member bonded to an upper end of the seal member and located within the cartridge housing to prevent inward movement of the upper end of the seal member;

an annular rigid outer support member bonded to an outer wall portion of the seal member and located within the cartridge housing to prevent inward movement of the outer wall portion; and an annular recess located in the seal member between the outer support member and the upper support member and spaced inward from the cartridge housing to allow outward movement of an outer upper portion of the seal member due to deformation by the drilling fluid pressure.

10. The stripper assembly according to claim 4, wherein the cartridge housing has an outer wall containing at least one hole in a lower portion of the outer wall and the stripper assembly further comprises:

an annular rigid lower support member bonded to a lower end of the seal member and located within the cartridge housing to prevent inward movement of the lower end of the seal member;

an annular rigid upper support member bonded to an upper end of the seal member and located within the cartridge housing to prevent inward movement of the upper end of the seal member;

an annular rigid outer support member bonded to an outer wall portion of the seal member and located within the cartridge housing above the hole to prevent inward movement of the outer wall portion;

an annular recess located in the seal member between the outer support member and the upper support member and spaced inward from the outer wall of the cartridge housing to allow outward movement of an outer upper portion of the seal member due to deformation by the drilling fluid pressure; and wherein the seal member has an outer tapered portion extending from the outer support member to the lower support member inward from the hole in the outer wall of the cartridge housing.

* * * * *